US007138178B2

(12) United States Patent
Fujiwara et al.

(10) Patent No.: US 7,138,178 B2
(45) Date of Patent: Nov. 21, 2006

(54) FIBER FOR ARTIFICIAL HAIR AND PROCESS FOR PRODUCING THE SAME

(75) Inventors: Kazuaki Fujiwara, Himeiji (JP); Satoru Yoshimura, Akashi (JP)

(73) Assignee: Kaneka Corporation, Osaka (JP)

( * ) Notice: Subject to any disclaimer, the term of this patent is extended or adjusted under 35 U.S.C. 154(b) by 0 days.

(21) Appl. No.: 10/522,710

(22) PCT Filed: Jul. 14, 2003

(86) PCT No.: PCT/JP03/08943

§ 371 (c)(1),
(2), (4) Date: Jul. 14, 2005

(87) PCT Pub. No.: WO2004/012542

PCT Pub. Date: Feb. 12, 2004

(65) Prior Publication Data

US 2006/0024497 A1 Feb. 2, 2006

(30) Foreign Application Priority Data

Jul. 31, 2002 (JP) ..... 2002-222387

(51) Int. Cl.
*D01F 6/00* (2006.01)

(52) U.S. Cl. ..... 428/364; 428/394; 428/399

(58) Field of Classification Search ..... 428/364, 428/394, 399; 524/180
See application file for complete search history.

(56) References Cited

U.S. PATENT DOCUMENTS 4,409,350 A * 10/1983 Fujiwara et al. ..... 524/180

FOREIGN PATENT DOCUMENTS

| | | |
|---|---|---|
| JP | 0 320 521 A1 | 6/1989 |
| JP | 05-086505 | 4/1993 |
| JP | 06-287801 | 10/1994 |
| JP | 06-316802 | 11/1994 |
| JP | 07-133586 | 5/1995 |

* cited by examiner

*Primary Examiner*—N. Edwards
(74) *Attorney, Agent, or Firm*—Kenyon & Kenyon LLP

(57) ABSTRACT

A fiber having unique gloss of appearance (flickering gloss) with light diffusibility, while maintaining natural feeling of gloss necessary as fiber for hair, is provided. The present invention may be attained by an artificial fiber for hair obtained from an acrylic based synthetic fiber having a single fiber size of 20 dtex to 80 dtex, the fiber having a maximum reflectance to a white light of 15% to 36% in case of a fiber having less than 21 of L value, or of 36% to 70% in case of a fiber having not less than 21 of L value, and having an optical diffusion coefficient of not less than 0.25.

4 Claims, 4 Drawing Sheets

Side view of fiber (image view)

FIBER FOR ARTIFICIAL HAIR AND PROCESS FOR PRODUCING THE SAME

This is a 371 national phase application of PCT/JP2003/008943 filled 14 Jul. 2003, claiming priority to Japanese Application No. 2002-222387 filed 31 Jul. 2002, the contents of which are incorporated herein by reference.

FIELD OF THE INVENTION

The present invention relates to a fiber for artificial hair, such as wigs, hairpieces, braids, extension hair, headdress for dolls, etc. Furthermore, it specifically relates to a novel fiber for artificial hair exhibiting reflective characteristics accompanied by light diffusibility and having unique appearance-gloss, and also to a method for manufacturing the same.

BACKGROUND ART

Acrylic based fibers, vinyl chloride based fibers, vinylidene chloride based fibers, polyester fibers, nylon fibers, polypropylene fibers, etc. are known well as fibers for artificial hair. These fibers are applied in fields, such as wigs, hair accessories, weavings, braids, extension hair, and hair for dolls, and various investigation has been performed until today in order to provide characteristics necessary as fibers for hair, such as improvement in touch and gloss, combing ability, curl retentivity, stylability (fiber performance enabling various styles in wig application).

Especially in gloss, since these synthetic fibers have very smooth fiber surface, in general, they are not suitable for a fiber for hair without specific treatment in respect of appearance, touch, etc. Therefore, there have been made efforts for exhibiting gloss similar to human hair, such as: methods by addition of dulling agent currently disclosed in Japanese Patent Publication No. No. 56-44164, Japanese Patent Laid-Open No. 56-309, Japanese Patent Laid-Open No. 56-311, etc., and methods by surface-roughing currently disclosed in Japanese Patent Laid-Open No. 61-245301, Japanese Patent Laid-Open No. 63-12716, Japanese Patent Laid-Open No. 05-140807, Japanese Patent Laid-Open No. 5-140817, etc., thereby enabling broad use for hair article.

However, in recent years, greater importance is being placed on fashionability also in headdress field, and as a result fibers having specific brightness and higher-class feeling are strongly desired to be marketed. Although conventional fibers exhibit natural feeling of gloss by the above-mentioned addition of dulling agent or by surface treatment, minute uneven shape on a surface of the fibers gives only monotonous appearance-gloss, and cannot fully satisfy requests in market in the present circumstances.

SUMMARY OF THE INVENTION

An object of the present invention is to provide a fiber that has unique gloss of appearance (flickering gloss) with light diffusibility while maintaining natural gloss necessary for fibers for hair.

As a result of wholehearted investigation performed by the present inventors in order to develop a fiber having unique appearance-gloss while satisfying requests in market, application of a specific knot-like unevenness shape on a fiber surface successfully enabled development of a fiber with unique gloss of appearance having light diffusibility, that is, flickering gloss, and furthermore, it was also found out that the unique targeted gloss of appearance can be expressed using a reflectance to a white light, and an optical diffusion coefficient, and in addition an appropriate range thereof was also found out, leading to completion of the present invention.

That is, the present invention relates to an artificial fiber for hair obtained from an acrylic based synthetic fiber having a single fiber size of 20 dtex to 80 dtex, the artificial fiber comprising: a reflectance to a white light within a range of either of following (1) or (2); and an optical diffusion coefficient of a fiber of not less than 0.25.

(1) A reflectance of 15% to 36% in case of a fiber with an L value of less than 21 in Hunter's Lab.

(2) A reflectance of 36% to 70% in case of a fiber with an L value of not less than 21 in Hunter's Lab.

And furthermore, as a preferable embodiment, the present invention relates to an artificial fiber for hair having a knot-like unevenness on a fiber surface, an average difference of height between a projected area and a depressed area of 5 micrometers to 15 micrometers, and a distance between peaks of adjacent projected areas in a range of 0.05 mm to 0.5 mm.

Moreover, the present invention relates to an artificial fiber for hair obtained from a resin composition having, as a principal component, a polymer consisting of acrylonitrile 30% to 85% by weight, a halogen containing monomer 14% to 69% by weight, and a hydrophilic olefin based monomer having a sulfonic acid group 1.0% to 3.0% by weight, The present invention also relates to a method for manufacturing an artificial fiber for hair, using a spinning solution prepared using an organic solvent so as to give a viscosity of 3 Pa-sec to 10 Pa-sec in wet spinning of the resin composition, using a nozzle having an L/W value of a projection of 0.5 to 2.0, and a cross section shape with 4 to 8 projections connected in a radial direction, performing wet spinning under a condition of a nozzle draft coefficient of 0.8 to 1.3, and then drying a fiber obtained under a wet and heated atmosphere with a dry heating temperature of not less than 120 degrees C. and with a wet-bulb temperature of not less than 70 degrees C. after washing with water.

Hereinafter, detailed description of the present invention will be given. An artificial fiber for hair of the present invention is an acrylic based synthetic fiber obtained from an acrylic based copolymer including acrylonitrile, and preferably is an acrylic based synthetic fiber obtained from a resin composition having, as a principal component, a polymer consisting of acrylonitrile 30% to 85% by weight, a halogen containing monomer 14% to 69% by weight, and a hydrophilic olefin based monomer having a sulfonic acid group 1.0% to 3.0% by weight.

The halogen containing monomer as used herein includes, but not limited to, vinyl chloride, vinylidene chloride, vinyl bromide, vinylidene bromide, etc. Vinylidene chloride and vinyl chloride are preferable in respect of easy availability among them. Moreover, other mono-olefin based monomers copolymerizable with them may also be used, if needed, by a grade not disturbing the present invention.

As other mono-olefin based monomers, for example, acrylic acid, methacrylic acid and esters thereof, acrylamide, vinyl acetate, etc. may be mentioned, and among them methyl acrylate and methyl methacrylate are preferable in view of excellent reactivity and improvement in dye affinity. Less than 14% by weight of the halogen containing monomer in the acrylic based copolymer may not easily give soft and animal hairs-like touch, and an amount exceeding 69% by weight reduces heat resistance and shows an undesirable tendency for the fibers to be easily welded together during a manufacturing process.

Moreover, as hydrophilic olefin based monomers including a sulfonic acid group, for example, but not limited to, includes sodium para-styrenesulfonate, sodium methallyl sulfonate, sodium isoprenesulfonate (2-methyl-1,3-butadiene-1-sodiumsulfonate), sodium 2-acrylamido-2-methyl propanesulfonate (acrylamide-t-butyl-sodiumsulfonate), para-styrene sulfonate, methallyl sulfonate, isoprene sulfonate (2-methyl-1,3-butadiene-1-sulfonate), 2-acrylamido-2-methyl propane sulfonate (acrylamido-t-butyl-sulfonate) etc.

Moreover, from a viewpoint of excellent reactivity and easy availability, sodium para-styrenesulfonate, sodium methallylsulfonate or sodium isoprene sulfonate, and 2-acrylamido-2-methyl propane sulfonate (acrylamido-t-butyl-sulfonate) are preferable. In order to form predetermined voids in a coagulation bath, this hydrophilic olefin based monomer including a sulfonic acid group is especially necessary, and a content thereof is preferably in a range of 1.0% to 3.0% by weight in an acrylic based copolymer. A content outside this range cannot develop voids having a target size in a coagulation bath, resulting in difficulty of providing a fiber having target unevenness by a manufacturing method of the present invention, except when the target unique appearance characteristics and unevenness on a surface of the fiber are given without forming voids.

Reflectance to a white light as used in the present invention is an index designating a gloss value (luster) of a fiber, which is obtained as a maximum reflectance as follows. Eleven fibers are optionally chosen from a fiber bundle, a reflected light distribution from the fibers for incident light with an angle of incidence of 30 degrees is measured using Murakami Color Research Laboratory glossimeter (GONIOPHOTO METERGP-200 type), and a halogen lamp (white) as a light source. FIG. 1 shows an example of a reflected light distribution. In FIG. 1, reference figure (a) gives a value of a maximum reflectance.

Natural feeling of gloss as artificial hair may be obtained by adjusting a reflectance to a white light of an artificial fiber for hair of the present invention to a range of 15% to 36%, in case of a fiber with an L value in Hunter's Lab of less than 21, and by adjusting to a range of 36% to 70% in case of a fiber with an L value in Hunter's Lab not less than 21.

An L value of Hunter's Lab here represents a value measured by a method according to JIS Z 8722, and an L value represents lightness. A fiber having an L value of less than 21, in general, is equivalent to a deep color fiber, and a fiber having a value L of not less than 21 is equivalent to a fiber of medium color to light color. When a fiber equivalent to each of the L values has a reflectance lower than the range, the fiber will become a fiber similar to kemp, giving dull hue with low commercial value. On the other hand, a reflectance out of the range may give plastic gloss, and the fiber then is not suitable for a fiber for hair.

An optical diffusion coefficient as used herein represents dispersion property of a reflected light in the present invention. A half value breadth (b) is obtained, which is a width of distribution of a value of a half of maximum reflectance (a) from the reflected light distribution (FIG. 1) obtained on a same measurement conditions as of the reflectance. The value is calculated by a following equation.

$$\text{Optical diffusion coefficient } (D) = b/a$$

Where, a: Maximum reflectance (%)

b: Half value breadth (degree).

This optical diffusion coefficient has a good correlation with a flickering gloss given by a visually observed fiber. The larger diffusion coefficient may give larger flicker degree, and an article of final stage, such as wigs, may exhibit unique gloss of appearance not found in conventional products, resulting in a high-grade article. According to inventors' teaching, in order to exhibit flickering gloss for visual observation, a diffusion coefficient of not less than 0.25 is necessary, and a diffusion coefficient of less than 0.25 gave only a little flickering gloss, and gave appearance of article practically similar to conventional article.

When an artificial fiber for hair of the present invention has, on a fiber surface thereof, a knot-like unevenness, 5 micrometers to 15 micrometers of a difference of average height between a projected area and a depressed area, and a distance between peaks of adjacent projected areas in a range of 0.05 mm to 0.5 mm, numerical ranges of a reflectance to a white light and an optical diffusion coefficient may preferably be satisfied.

Furthermore, a difference of average height between a projected area and a depressed area is preferably 6 micrometers to 12 micrometers, and a distance between peaks of adjacent projected areas is 0.06 mm to 0.40 mm. Here, an expression "fiber surface has a knot-like unevenness" designates a shape as schematically shown, for example in FIG. 2. A difference of average height between a projected area and a depressed area at this time may be obtained by measuring a length of a thicker portion of a fiber (H1), and a finer portion (H2) in FIG. 2, and calculated with a following equation.

$$\text{A difference of average height between a projected area and a depressed area } (H) = (H1 - H2) \times 1/2$$

Where,

H1: a length of thicker portion

H2: a length of finer portion.

Moreover, as shown in FIG. 2, a distance between peaks of adjacent projected areas may also be obtained by measuring a pitch between peaks of adjacent projected areas.

The present inventors found out that a fiber having unique gloss of appearance with light diffusibility, i.e., flickering gloss, might be obtained by applying uneven shape in this particular range to a fiber surface.

When a difference of average height between a projected area and a depressed area is smaller than 5 micrometers, or when a distance between peaks of adjacent projected areas is larger than 0.5 mm, other design ideas are necessary in order to obtain a target fiber having not less than 0.25 of optical diffusion coefficients. Although a difference of average height between a projected area and a depressed area exceeding 15 micrometers increases optical diffusion coefficient, it disadvantageously gives excessive rough touch for a fiber to worsen feeling, except when gloss of appearance is realized by other design ideas.

A single fiber size of an artificial fiber for hair of the present invention is 20 dtex to 80 dtex. A size of a fiber of less than 20 dtex exhibits touch with excessive softness and without resilience, resulting in unsuitable fiber for a headdress product. On the other hand, since a size of a fiber exceeding 80 dtex gives rigid touch to a fiber and significantly reduces touch of the fiber, it is important that the fiber preferably has an appropriate size of 30 dtex to 70 dtex.

A description about a method for manufacturing an artificial fiber for hair of the present invention will hereinafter be given. Although a method of manufacturing an artificial fiber for hair of the present invention is not especially limited, for example, the fiber can be manufactured by following methods.

Any polymerization methods for vinyl based monomers usually known may be used as copolymerization methods for acrylic based polymers used for an artificial fiber for hair of the present invention, and for example, a suspension polymerization method, a solution polymerization method, an emulsion polymerization method, etc. may be mentioned.

Next, a resin composition having an acrylic based polymer as a principal component is dissolved in an organic solvent to prepare a spinning solution. The organic solvents used here for the spinning solution are not especially limited, as long as they dissolve the resin composition, and for example, dimethylformamide, dimethylacetamide, dimethylsulfoxide, acetone, acetonitrile, etc. may be mentioned. Moreover, it is also possible to add to the spinning solution matting agents, coloring stabilizers, flame resistant agents, light stabilizers, rust preventives, antistatic agents, antibacteria agents, etc. if needed.

A viscosity of the spinning solution is preferably in a range of 3 Pa-sec to 10 Pa-sec, and more preferably in a range of 4 Pa-sec to 8 Pa-sec. This preferable range of the viscosity of the spinning solution is a condition necessary for formation of specific voids in a coagulation bath mentioned later. A viscosity of the spinning solution of less than 3 Pa-sec gives excessively large voids formed in the coagulation bath, and worsens recoverability of lost transparency in a drying process, disadvantageously resulting in a fiber with kemp tone having dull hue.

On the other hand, a viscosity exceeding 10 Pa-sec of the spinning solution makes the fiber denser in the coagulation bath, cannot form voids having a target size to provide a fiber surface having a small degree of uneven shape, and as a result only a fiber with small optical diffusion coefficient can be obtained.

A spinning solution prepared in this way is then spun by a usual wet spinning method, and the spinning solution is preferably spun using, as a nozzle to be used, a nozzle having a cross section shape with an L/W value for projections of 0.5 to 2.0, and having 4 to 8 projections connected in radial directions.

The nozzle is used in order to obtain a yarn having voids with a size of about 5 micrometers to 30 micrometers in the coagulation bath, and the voids are believed to be crushed in a next drying process, thus presenting a knot-like unevenness on a fiber surface.

A cross section shape as used herein that has projections connected in radial directions is a cross section shape as shown, for example in (a) to (c) of FIG. 3, and an L/W value for a projection is represented with a ratio (L/W) of a length (L) and a width (W) of the projection as shown in FIG. 4. Use of the nozzle with the shape of the range enables development of the target voids in the coagulation bath. An L/W value less than 0.5 makes a diameter of the voids smaller, and an L/W value exceeding 2.0 excessively enlarges a diameter of the voids, leading to a problem of difficulty in recovery of lost transparency.

Moreover, a number of projections of the nozzle is preferably 4 to 8, and more preferably 5 to 7. A number smaller than 4 fails to allow development of the voids, but a number exceeding 8 reduces a slit width of the nozzle, causing an undesirable problem of poor spinnability.

Furthermore, in spinning of the spinning solution through the nozzle, a nozzle draft coefficient may preferably be set to 0.8 to 1.3. The nozzle draft coefficient may be calculated by a equation described later. A nozzle draft coefficient smaller than 0.8 fails to develop voids having a target size, and a nozzle draft coefficient exceeding 1.3 easily causes yarn breakage etc.

$$\text{Nozzle draft coefficient} = V0/V1$$

V0: Linear velocity at a nozzle outlet

V1: Taking up linear velocity

After formation of specific voids in a coagulation bath by the above-mentioned method, water-washing with warm water etc., and drawing are carried out, and subsequently drying under specific conditions is performed. Specifically, drying is performed under an atmosphere with wet hot wind of a dry heating temperature of not less than 120 degrees C., and a wet-bulb temperature of not less than 70 degrees C.

It is difficult for usual drying conditions to recover lost transparency, since large voids are formed in a stage of solidification of a yarn, and therefore, it is necessary to use the above-mentioned drying conditions. Especially a wet-bulb temperature is important and it is preferably not less than 70 degrees C., and more preferably no less than 80 degrees C.

A wet-bulb temperature as used herein is a temperature measured using what is called a psychrometer having a temperature sensor wrapped with a wet cloth in a thermometer. A higher wet-bulb temperature means more moisture contents under a drying atmosphere, and therefore much more heat conduction to a fiber may be realized as compared with usual dry hot wind, probably causing easy crushing of the voids.

A dry heating temperature lower than 120 degrees C. or a wet-bulb temperature lower than 70 degrees C. cannot provide satisfactory crushing of the voids, and as a result, only a fiber having small degree of unevenness and small optical diffusion coefficient is obtained.

The manufacturing method of the present invention is characterized by providing a fiber surface with uneven shape due to crushing under specific drying conditions large voids formed in solidification. The above-mentioned viscosity of the spinning solution, a nozzle with a particular shape, a nozzle draft coefficient, and drying conditions are especially important, and by satisfying these manufacturing conditions, a target artificial fiber for hair can be obtained. However, it is not limited to obtain an artificial fiber for hair of the present invention by methods other than manufacturing conditions of the present invention.

BEST MODE FOR CARRYING-OUT OF THE INVENTION

Although, detailed description of the present invention will, hereinafter, be given based on Examples, the present invention is not limited to these Examples at all. Definitions of measuring methods etc. will be described in advance of description of Examples.

(Maximum Reflectance)

Eleven numbers of fibers were optionally chosen from a fiber bundle, and the fibers were measured for a reflected light distribution from the fibers with a light at 30 degrees of angle of incidence to obtain a maximum reflectance, using a glossimeter by Murakami Color Research Laboratory (GONIOPHOTO METER GP-200 type) with a halogen lamp (12 V, 50 W) as a light source, at a voltage of −760 V.

(Optical Diffusion Coefficient)

Figure 1:
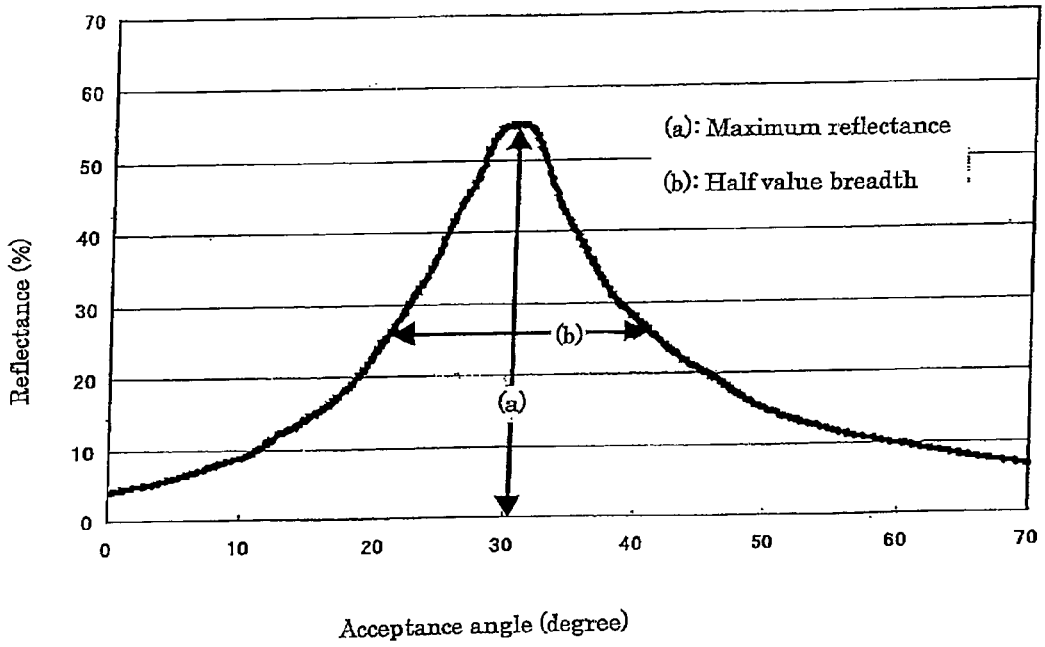
FIG. 1 shows a diagram of a maximum reflectance and a half value breadth based on an example of a distribution of reflected light of an incident white light to a fiber.

A half value breadth designating a distribution width of a value of a half of a maximum reflectance was determined, from a reflected light distribution obtained by the method. Optical diffusion coefficient was calculated using a following equation. (Refer to FIG. 1)

$$\text{Optical (diffusion coefficient } D) = b/a$$

Where, a: Reflectance (%), b: Half value breadth (degree).

(L Value)

Using a colorimetric photometer made by [Nippon Denshoku Co., Ltd.] (Σ 90), and a whiteness standard plate attached to the photometer, a bundle of fibers of a length of 20 cm and gross size 900,000 dtex was placed sideways, on a reflective sample stand with 30 ϕ, and measurement was performed 3 times by a method according to JIS Z 8722. An average (L value) was calculated.

(Fiber Surface Unevenness Measurement)

A side surface of the a was observed by a magnification of 100 times using an optical microscope made by Olympus Corporation, and as shown in second figure, a thicker portion and a finer portion of the fiber were measured for H1 and H2, and H was calculated by a following equation. In addition, measurement was performed with n=30 and an average was calculated.

$$\text{Difference of average height of a projected area and a depressed area } (H) = (H1 - H2) \times ½$$

H1: length of thicker portion

H2: length of finer portion

Figure 2:
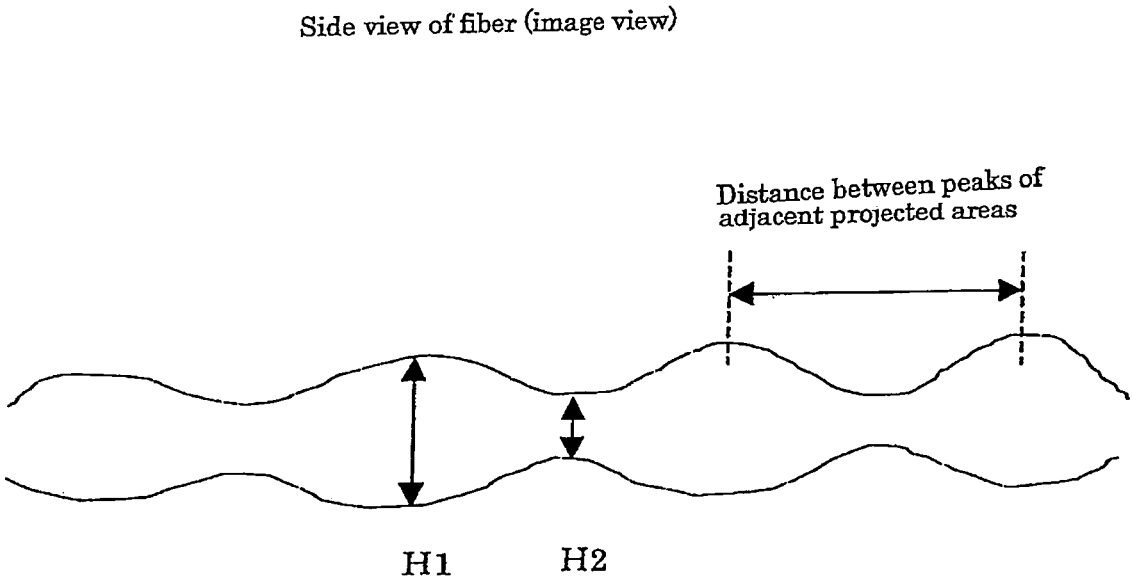
FIG. 2 is a schematical diagram (a section in a lengthwise direction of a fiber) of an uneven shape of an artificial fiber for hair of the present invention.

Moreover, a distance between peaks of adjacent projected areas was also measured for 30 portions, as shown in FIG. 2, and an average was calculated.

(Spinning Solution Viscosity)

A solution was measured for a viscosity at 40 degrees C. using a B-type viscometer manufactured by Shibaura Systems Co., Ltd.

(Gloss of Appearance Evaluation)

Using a fiber bundle of gross size900,000 dtex, a flicker degree of gloss was sensuously evaluated by five persons based on visual feeling, and evaluation was made with three steps of following criteria for gloss of appearance.

○: Flickering gloss with unique appearance observed

Δ: A small degree of insufficient flickering gloss observed

X : Flickering gloss hardly observed

EXAMPLE 1

An acrylic based polymer consisting of acrylonitrile (AN) 52% by weight, vinylidene chloride (VD) 46.5% by weight, and sodium styrene sulfonate (3S) 1.5% by weight was dissolved in acetone, to obtain a spinning solution with a viscosity of 5 Pa-sec by adjusting a resin concentration to 26% by weight.

Figure 3:
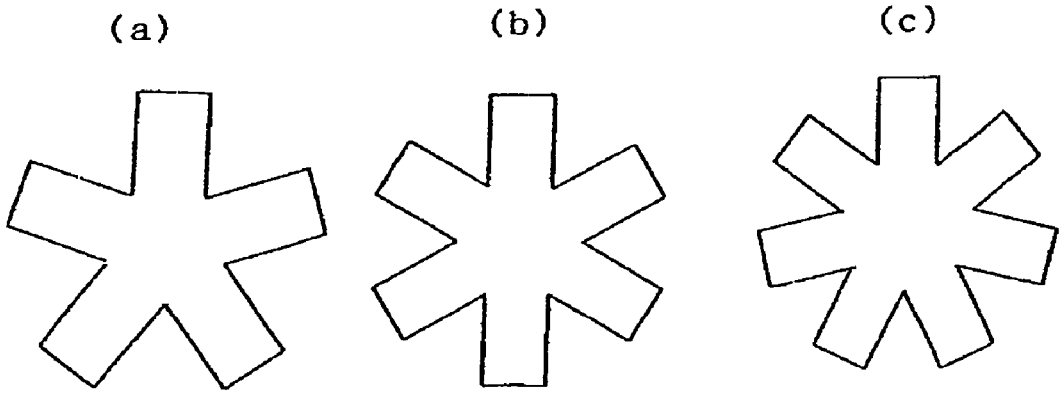
FIG. 3 is an example of a cross section shape of a nozzle used in a manufacturing method of the present invention.
Figure 4:
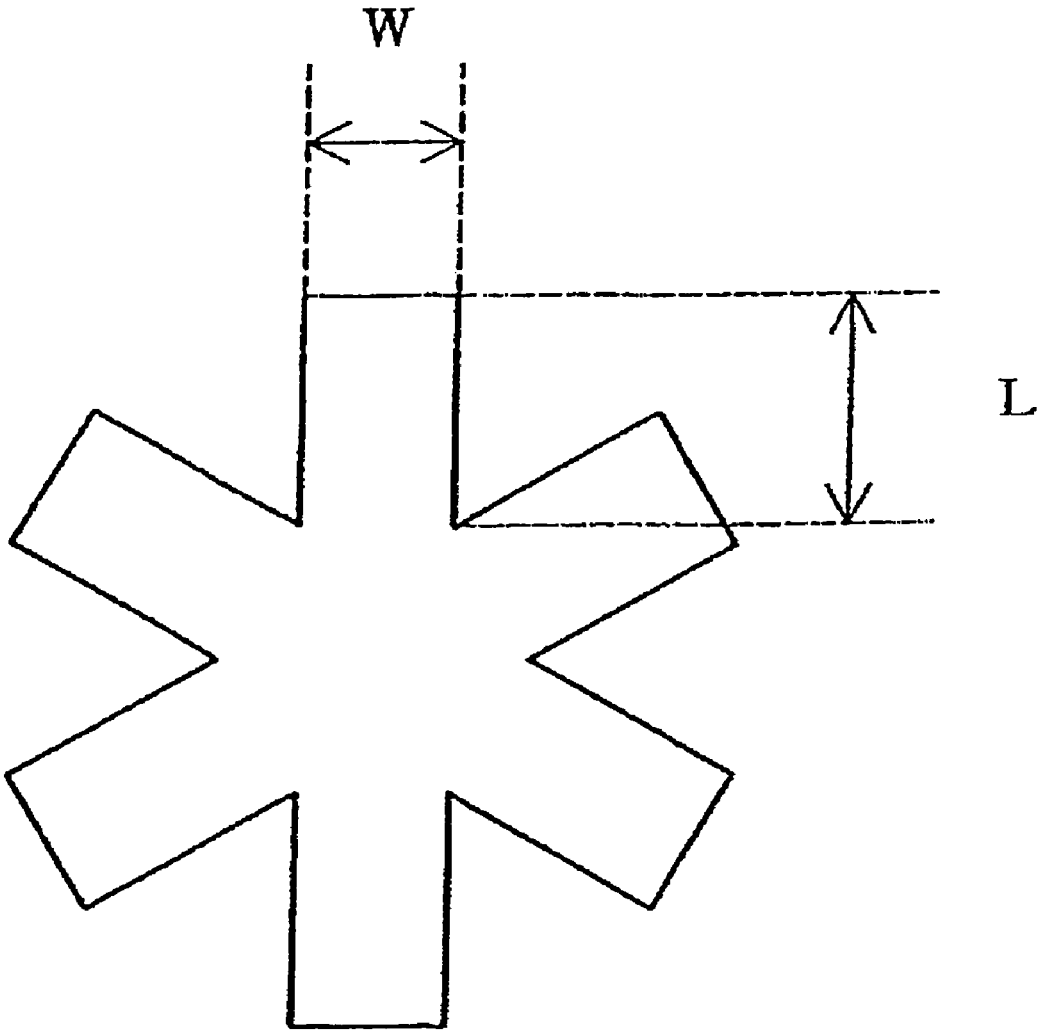
FIG. 4 is a diagram of a value L and a value W for projections of a nozzle used in a manufacturing method of the present invention.

This spinning solution was extruded in a coagulation bath of acetone/water having 36% by weight of acetone concentration at 20 degree C., using a nozzle [FIG. 3(*b*)] that has a cross section shape having six projections connected in radial directions with 1.4 of an L/W value, and that has a pore size of 0.3 ϕ and a number of holes of 50, with a nozzle draft coefficient of 0.9. Subsequently, a yarn obtained was introduced into a water-washing bath at 50 to 60 degrees C., and a 1.9 times of preliminary drawing was given with concurrent washing by water.

After 2.0 times of hot drawing, lost transparency was recovered by drying under an atmosphere of wet heated wind of a dry heating temperature of 125 degree C., and a wet-bulb temperature of 80 degree C., 10% of relaxation heat treatment was performed under a 160-degree C. dry heating atmosphere.

The obtained fiber was a white fiber having a single fiber size of 50 dtex, and an L value of 85, and it had an uneven shape on a fiber surface thereof, a difference of average height between a projected area and a depressed area of 8 micrometers, and an average distance between peaks of adjacent projected areas of 0.25 mm. Moreover, a maximum reflectance to a white light (halogen lamp) gave 55%, and an optical diffusion coefficient 0.32.

EXAMPLE 2

After a similar fiber as in Example 1 was manufactured, a fiber with brown hue was obtained by a piece dyeing processing using a following method.

In the piece dyeing processing method, boiling of 1 hour at an ordinary pressure was performed at a bath ratio of 1:25, using cationic dyes (Maxilon Yellow 2RL 0.36% omf, Maxilon Red GRL 0.06% omf, Maxilon Blue GRL 0.18% omf, manufactured by Ciba-Geigy Corp.), as an auxiliary agent, acetic acid, sodium acetate, and anionic dispersing agent 2% omf (Levenol WX: made by Kao Corp.), and an accelerating agent 0.4% omf (sodium lauryl sulfate), and then water-washing and drying treatment were performed. A fiber after dyed was a brown fiber having an L value of 31, and it had 36% of maximum reflectance and 0.40 of light diffusion coefficient.

EXAMPLE 3

After a similar fiber as in Example 1 was manufactured, a fiber with black hue was obtained by a piece dyeing processing using a following method.

In the piece dyeing processing method, boiling of 1 hour at an ordinary pressure was performed at a bath ratio of 1:25, using cationic dyes (Maxilon Yellow 2RL 0.78% omf, Maxilon Red GRL 0.24% omf, Maxilon Blue GRL 0.58% omf, manufactured by Ciba-Geigy Corp.), as an auxiliary agent, acetic acid, sodium acetate, and anionic dispersing agent 2% omf (Levenol WX: made by Kao Corp.), and an accelerating agent 0.6% omf (sodium lauryl sulfate), and then water-washing and drying treatment were performed.

The fiber after dyed was a black fiber having an L value of 17, and it had 24% of maximum reflectance, and 0.45 optical diffusion coefficient.

EXAMPLE 4

An acrylic based polymer consisting of acrylonitrile 56% by weight, vinylidene chloride 42% by weight, and sodium styrene sulfonate 2% by weight was dissolved in DMF (N,N-dimethylformamide), to obtain a spinning solution with a viscosity of 8 Pa-sec by adjusting a resin concentration to 25% by weight. Subsequently, using a same nozzle as in Example 1, at a nozzle draft coefficient of 0.9, the spinning solution was extruded in an aqueous solution with 50% by weight of DMF. Subsequently, the fiber obtained was introduced into a water-washing bath at 80 degrees C., and a 2.0 times of preliminary drawing was given with concurrent washing by water.

After 2.0 times of hot drawing, lost transparency was recovered by drying under an atmosphere of wet heated wind of a dry heating temperature of 140 degree C., and a wet-bulb temperature of 80 degree C., 8% of relaxation heat treatment was performed under a 160-degree C. dry heating atmosphere. Subsequently, the fiber was colored by a similar method as in Example 2, and a brown fiber having a single fiber size of 50 dtex and an L value of 35 was obtained.

The obtained fiber had uneven shape, and moreover a difference of average height between the projected area and the depressed area of 7 micrometers, and an average distance between peaks of adjacent projected areas of 0.27 mm on a surface thereof. Moreover, the fiber had a 37% of maximum reflectance to white light and an optical diffusion coefficient of 0.36.

COMPARATIVE EXAMPLE 1

An acrylic based copolymer consisting of acrylonitrile 49% by weight, vinyl chloride 50.5% by weight, and sodium styrene sulfonate 0.5% by weight was dissolved in acetone to give a resin concentration of 28% by weight, and a spinning solution having a viscosity of 4 Pa-sec was obtained. Subsequently, the spinning solution was extruded with a nozzle draft coefficient of 0.9, using a same nozzle as in Example 1, in a coagulation bath of acetone/water having 36% by weight of acetone concentration, at 20 degrees C. Subsequently, a yarn obtained was introduced into a water-washing bath at 50 degrees C. to 60 degrees C., and a 1.9 times of preliminary drawing was given with concurrent washing by water.

After 2.0 times of hot drawing, lost transparency was recovered by drying under an atmosphere of wet heated wind of a dry heating temperature of 125 degree C., and a wet-bulb temperature of 80 degree C., 10% of relaxation heat treatment was performed under a 145-degree C. dry heating atmosphere. Subsequently, the fiber was colored by a similar method as in Example 2, and a brown fiber having a single fiber size of 50 dtex and an L value of 26 was obtained.

The obtained fiber had almost no uneven shape on a fiber surface thereof, but unevenness evaluation by an optical microscope having 100 times of magnification of the fiber proved to be difficult to recognize unevenness. Moreover, this fiber had a 75% of maximum reflectance to a white light, and optical diffusion coefficient of 0.10, and it gave plastics-like gloss and insufficient result.

COMPARATIVE EXAMPLE 2

An acrylic based polymer consisting of acrylonitrile 49% by weight, vinyl chloride 50% by weight, and sodium styrene sulfonate 1.0% by weight was dissolved in acetone, to obtain a spinning solution with a viscosity of 4 Pa-sec by adjusting a resin concentration to 28% by weight. Subsequently, the spinning solution was extruded with a nozzle draft coefficient of 0.7, using a same nozzle as in Example 1, in a coagulation bath of acetone/water having 36% by weight of acetone concentration, at 20 degrees C. Then, the fiber obtained was introduced into a water-washing bath at 50 degrees C. to 60 degrees C., and a 1.9 times of-preliminary drawing was given with concurrent washing by water.

After 2.0 times of hot drawing, lost transparency was recovered by drying under an atmosphere of wet heated wind of a dry heating temperature of 125 degree C., and a wet-bulb temperature of 80 degree C., 10% of relaxation heat treatment was performed under a 145-degree C. dry heating atmosphere. Subsequently, the fiber was colored by a similar method as in Example 2, and a brown fiber having a single fiber size of 50 dtex and an L value of 28 was obtained.

Although the obtained fiber has a surface unevenness shape, it had a difference of average height between a projected area and a depressed area of 4 micron, and an average distance between peaks of adjacent projected areas of 0.27 mm, showing a small uneven degree. Moreover, it had a low optical diffusion coefficient of 0.18, and evaluation by naked eye gave insufficient flickering gloss.

COMPARATIVE EXAMPLE 3

An acrylic based copolymer having a same composition as in Example 1 was dissolved in acetone to give a resin concentration of 26% by weight, and a spinning solution having a viscosity of 5 Pa-sec was obtained. Subsequently, the spinning solution was extruded by a same method as in Example. 1, with a nozzle draft coefficient of 0.9, using a nozzle having round hole form, a pore size of 0.3 phi, and having 50 holes. Water-washing, drying, and heat treatment were performed by a similar method as in Example 1. Furthermore, the fiber was colored by a similar method as in Example 2 to obtain a brown fiber having a single fiber size of 50 dtex and an L value of 26.

The obtained fiber had almost no uneven shape on a fiber surface thereof, but unevenness evaluation by an optical microscope having 100 times of magnification of the fiber proved to be difficult to recognize unevenness. Moreover, this fiber had a 82% of maximum reflectance to a white light, and optical diffusion coefficient of 0.08, and it showed plastics-like gloss and gave insufficient result.

COMPARATIVE EXAMPLE 4

An acrylic based copolymer having a same composition as in Example 1 was dissolved in acetone to give a resin concentration of 26% by weight, and a spinning solution having a viscosity of 5 Pa-sec was obtained. Subsequently, the spinning solution was extruded with a nozzle draft coefficient of 0.9, using a same nozzle as in Example 1, in a coagulation bath of acetone/water having 36% by weight of acetone concentration, at 20 degrees C. Then, the fiber obtained was introduced into a water-washing bath at 50 degrees C. to 60 degrees C., and a 1.9 times of preliminary drawing was given with concurrent washing by water.

After 2.0 times of hot drawing, drying was performed under an atmosphere of wet heated wind of a dry heating temperature of 125 degree C., and a wet-bulb temperature of 80 degree C., 10% of relaxation heat treatment was performed under a 160-degree C. dry heating atmosphere.

Subsequently, the fiber was colored by a similar method as in Example 2, and a brown fiber having a single fiber size of 50 dtex and an L value of 38 was obtained.

Inadequate recoverability of lost transparency gave an opaque fiber. Moreover, a result of evaluation of unevenness of this fiber gave a difference of average height between a projected area and a depressed area of 2 micrometers, and an average distance between peaks of adjacent projected areas of 0.30 mm. Moreover, maximum reflectance to a white light gave 28%, and an optical diffusion coefficient gave insufficient result of 0.15.

Table 1 shows results of evaluation of reflective characteristics of Example and Comparative Example and gloss of appearance.

TABLE 1

| | Polymer composition | Spinning solution viscosity Pa-sec | Nozzle shape L/W value | Nozzle draft coefficient | Drying conditions Wet-bulb temperature (degree C.) | Uneven degree of fiber: Uneven difference of average height [micrometer] | Uneven degree of fiber: Average distance between peaks of adjacent projected areas [mm] | L value Hue of fiber | Reflective characteristics: Optical diffusion coefficient | Reflective characteristics: Maximum reflectance % | Surface appearance evaluation Flickering gloss |
|---|---|---|---|---|---|---|---|---|---|---|---|
| Ex.1 | AN/VD/3S 52/46.5/1.5 | 5 | *-like shape 1.4 | 0.90 | 80 | 8 | 0.25 | 85 (white) | 0.32 | 55 | ○ |
| Ex.2 | AN/VD/3S 52/46.5/1.5 | 5 | *-like shape 1.4 | 0.90 | 80 | 8 | 0.25 | 31 (brown) | 0.40 | 36 | ○ |
| Ex.3 | AN/VD/3S 52/46.5/1.5 | 5 | *-like shape 1.4 | 0.90 | 80 | 8 | 0.25 | 17 (black) | 0.45 | 24 | ○ |
| Ex.4 | AN/VD/3S 52/42/2.0 | 8 | *-like shape 1.4 | 0.90 | 80 | 7 | 0.27 | 35 (brown) | 0.36 | 37 | ○ |
| Comp. Ex.1 | AN/VD/3S 49/50.5/0.5 | 4 | *-like shape 1.4 | 0.90 | 80 | Impossible to measure | Impossible to measure | 26 (brown) | 0.10 | 75 | x |
| Comp. Ex.2 | AN/VD/3S 49/50/1.0 | 4 | *-like shape 1.4 | 0.70 | 80 | 4 | 0.30 | 28 (brown) | 0.18 | 56 | Δ |
| Comp. Ex.3 | AN/VD/3S 52/46.5/1.5 | 5 | ○ shape- | 0.90 | 80 | Impossible to measure | Impossible to measure | 26 (brown) | 0.08 | 82 | x |
| Comp. Ex.4 | AN/VD/3S 52/46.5/1.5 | 5 | *-like shape 1.4 | 0.90 | 60 | 2 | 0.30 | 38 (brown) | 0.15 | 28 | x |

On one hand, Examples 1 to 4 having reflective characteristics to white light of a fiber (optical diffusion coefficient, maximum reflectance) within the present invention exhibit excellent flickering gloss to observation with naked eye, and show unique gloss of appearance. On the other hand, fibers of Comparative Examples 1 to 4 out of the present invention have small optical diffusion coefficients, and show inadequate flickering gloss.

INDUSTRIAL APPLICABILITY

An artificial fiber for hair of the present invention is a fiber having unique gloss of appearance and excellent designing property, while exhibiting natural feeling of gloss, and can be broadly used for application as wigs, hairpieces, braids, extension hairs, and headdress for dolls etc.

The invention claimed is:

1. An artificial fiber for hair obtained from an acrylic based synthetic fiber having a single fiber size of 20 dtex to 80 dtex, the artificial fiber comprising:

an optical diffusion coefficient of a fiber of not less than 0.25;

a reflectance to a white light within a range of either of following (1) or (2), (1) a reflectance of 15% to 36% in case of a fiber with an L value of less than 21 in Hunter's Lab, (2) a reflectance of 36% to 70% in case of a fiber with an L value of not less than 21 in Hunter's Lab;

a knot-shaped unevenness on a surface of the artificial fiber; and a difference of average height between a projected area and a depressed area of 5 micrometers to 15 micrometers on the surface.

2. The artificial fiber for hair according to claim 1 further comprising a distance between peaks of adjacent projected areas in a range of 0.05 mm to 0.5 mm.

3. The artificial fiber for hair according to claim 1, wherein the acrylic based synthetic fiber is obtained from a resin composition having, as a principal component, a polymer consisting of acrylonitrile 30% by weight to 85% by weight, a halogen containing monomer 14% by weight to 69% by weight, and a hydrophilic olefin based monomer having sulfonic acid group 1.0% by weight to 3.0% by weight.

4. The artificial fiber for hair according to claim 2, wherein the acrylic based synthetic fiber is obtained from a resin composition having, as a principal component, a polymer consisting of acrylonitrile 30% by weight to 85% by weight, a halogen containing monomer 14% by weight to 69% by weight, and a hydrophilic olefin based monomer having sulfonic acid group 1.0% by weight to 3.0% by weight.

* * * * *